US008540329B2

(12) United States Patent
Matoba

(10) Patent No.: US 8,540,329 B2
(45) Date of Patent: Sep. 24, 2013

(54) LIQUID EJECTION APPARATUS

(75) Inventor: Kenji Matoba, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 281 days.

(21) Appl. No.: 12/917,074

(22) Filed: Nov. 1, 2010

(65) Prior Publication Data

US 2011/0128313 A1 Jun. 2, 2011

(30) Foreign Application Priority Data

Nov. 27, 2009 (JP) ..... 2009-270529

(51) Int. Cl.
*B41J 29/38* (2006.01)

(52) U.S. Cl.
USPC ..... 347/6

(58) Field of Classification Search
USPC ..... 347/6, 7, 68, 89
See application file for complete search history.

(56) References Cited

U.S. PATENT DOCUMENTS

| | | | | |
|---|---|---|---|---|
| 3,925,788 | A * | 12/1975 | Kashio | 347/23 |
| 4,787,313 | A * | 11/1988 | Osborn et al. | 101/366 |
| 2008/0079791 | A1 | 4/2008 | Kang et al. | |
| 2008/0302259 | A1 * | 12/2008 | Katoh et al. | 101/128.4 |
| 2009/0183678 | A1 | 7/2009 | Yoshino et al. | |
| 2010/0283808 | A1 * | 11/2010 | Terakado et al. | 347/6 |

FOREIGN PATENT DOCUMENTS

| | | | |
|---|---|---|---|
| JP | H11188894 | A | 7/1999 |
| JP | 2000103074 | A | 4/2000 |
| JP | 2002-67347 | | 3/2002 |
| JP | 2003190867 | A | 7/2003 |
| JP | 2004-50537 | | 2/2004 |
| JP | 2004136587 | A | 5/2004 |
| JP | 2004-299295 | | 10/2004 |
| JP | 2005-125668 | | 5/2005 |
| JP | 2008012819 | A | 1/2008 |
| JP | 2008087465 | A | 4/2008 |
| JP | 2008207371 | A | 9/2008 |
| JP | 2009-172932 | | 8/2009 |
| JP | 2009172506 | A | 8/2009 |

OTHER PUBLICATIONS

English Machine Translation of JP 2006-068904A, Liquid Drop Ejector, Ricoh Co. LTD published Mar. 16, 2006.*
Japanese Office Action dated May 28, 2013 in related Japanese Patent Application No. 2009-270529.

* cited by examiner

*Primary Examiner* — Julian Huffman
*Assistant Examiner* — Sharon A Polk
(74) *Attorney, Agent, or Firm* — Scully, Scott, Murphy & Presser, P.C.

(57) ABSTRACT

A liquid ejection apparatus includes a valve which adjusts the flow rate of a recording liquid in a return passage connecting an outflow opening with a tank, a pump which supplies the recording liquid from the tank to the internal passage via the supply passage, a detecting unit which detects an operating state of the pump, and a calculating unit which calculates the viscosity of the recording liquid. The calculating unit calculates the viscosity of the recording liquid based on the operating state of the pump detected by the detecting unit, while the recording liquid in the tank circulates so as to serially pass through the supply passage, the internal passage, and the return passage.

8 Claims, 7 Drawing Sheets

LIQUID EJECTION APPARATUS

The present application claims priority from Japanese Patent Application No. 2009-270529, which was filed on Nov. 27, 2009, the disclosure of which is herein incorporated by reference in its entirety.

BACKGROUND OF THE INVENTION

1. Field of the Invention

The present invention relates to a liquid ejection apparatus having a recording liquid ejection head which ejects recording liquid from ejection openings.

2. Description of the Related Art

The performances regarding ink supply and ink ejection in an inkjet recording apparatus significantly depend on the viscosity of ink. There is a known recording apparatus which directly measures the ink viscosity by a viscosity meter such as capillary viscosity meter, falling-ball viscosity meter, and rotational viscosity meter is provided on an ink supply passage.

SUMMARY OF THE INVENTION

However, the apparatus must be large in size when a capillary viscosity meter, a falling-ball viscosity meter, or a rotational viscosity meter is provided on the ink passage of the product.

An object of the present invention is to provide a liquid ejection apparatus which can precisely calculate the viscosity of liquid without requiring a viscosity meter therein.

A liquid ejection apparatus of the present invention includes: a tank which stores a recording liquid; a recording liquid ejection head which includes an internal passage having an inflow opening and an outflow opening and a plurality of individual recording liquid passages each connecting outlets of the internal passage with ejection openings from which the recording liquid is ejected; a supply passage which connects the inflow opening with the tank; a return passage which connects the outflow opening with the tank; a valve which adjusts a flow rate of the recording liquid on the return passage; a pump which operates to supply the recording liquid from the tank to the internal passage via the supply passage; a pump control unit which controls the pump; a valve control unit which controls the valve; a detecting unit which detects an operating state of the pump; and a calculating unit which calculates the viscosity of the recording liquid; wherein, while the valve control unit controls the valve and the pump control unit controls the pump so that the recording liquid in the tank circulates by serially passing through the supply passage, the internal passage, and the return passage, the calculating unit calculates the viscosity of the recording liquid based on the operating state of the pump detected by the detecting unit.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
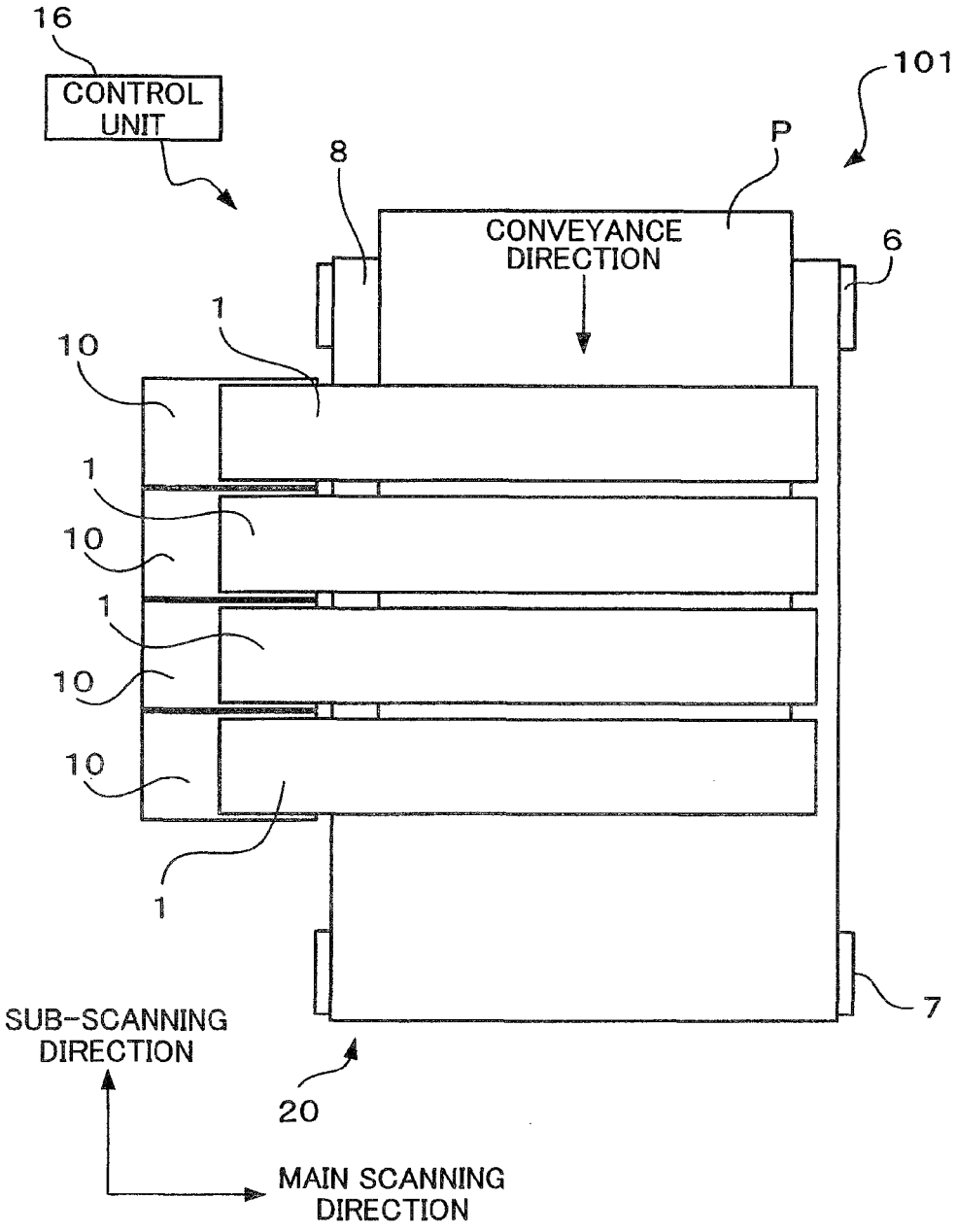
FIG. 1 is a schematic plan view of an inkjet printer according to an embodiment of the present invention.

An inkjet printer 101 according to an embodiment of the present invention includes, as shown in FIG. 1, a conveying unit 20 which conveys sheets P from upward to downward in FIG. 1, four inkjet heads 1 ejecting magenta, cyan, yellow, and black ink droplets respectively onto a sheet P conveyed by the conveying unit 20, four ink supply units 10 supplying ink to the inkjet heads 1, and a control unit 16. In the present embodiment, a sub-scanning direction is in parallel to the conveyance direction of the sheets P on the conveying unit 20, whereas a main scanning direction is orthogonal to the sub-scanning direction and along the horizontal plane.

The conveying unit 20 has two belt rollers 6 and 7 and an endless conveyor belt 8 stretched between the rollers 6 and 7. The belt roller 7 is a driving roller which is rotated by a driving force from an unillustrated conveyor motor. The belt roller 6 is a driven roller which rotates as the conveyor belt 8 is moved by the rotation of the belt roller 7. A sheet P placed on the outer circumferential surface of the conveyor belt 8 is conveyed downward in FIG. 1.

The four inkjet heads 1 are elongated in the main scanning direction to be in parallel to one another. Each inkjet head 1 has a plurality of ejection openings 108 (see FIG. 3) which eject ink droplets and are aligned in the main scanning direction. The inkjet printer 101 is a line-type color inkjet printer in which four inkjet heads 1 are fixedly provided to oppose the conveying passage on which sheets P are conveyed by the conveyor belt 8.

When a sheet P conveyed by the conveyor belt 8 is passing through the portions immediately below the four inkjet heads 1, ink droplets of the respective colors are serially ejected from the inkjet heads 1 to the upper surface of the sheet P, with the result that a desired color image is formed on the sheet P.

Figure 2:
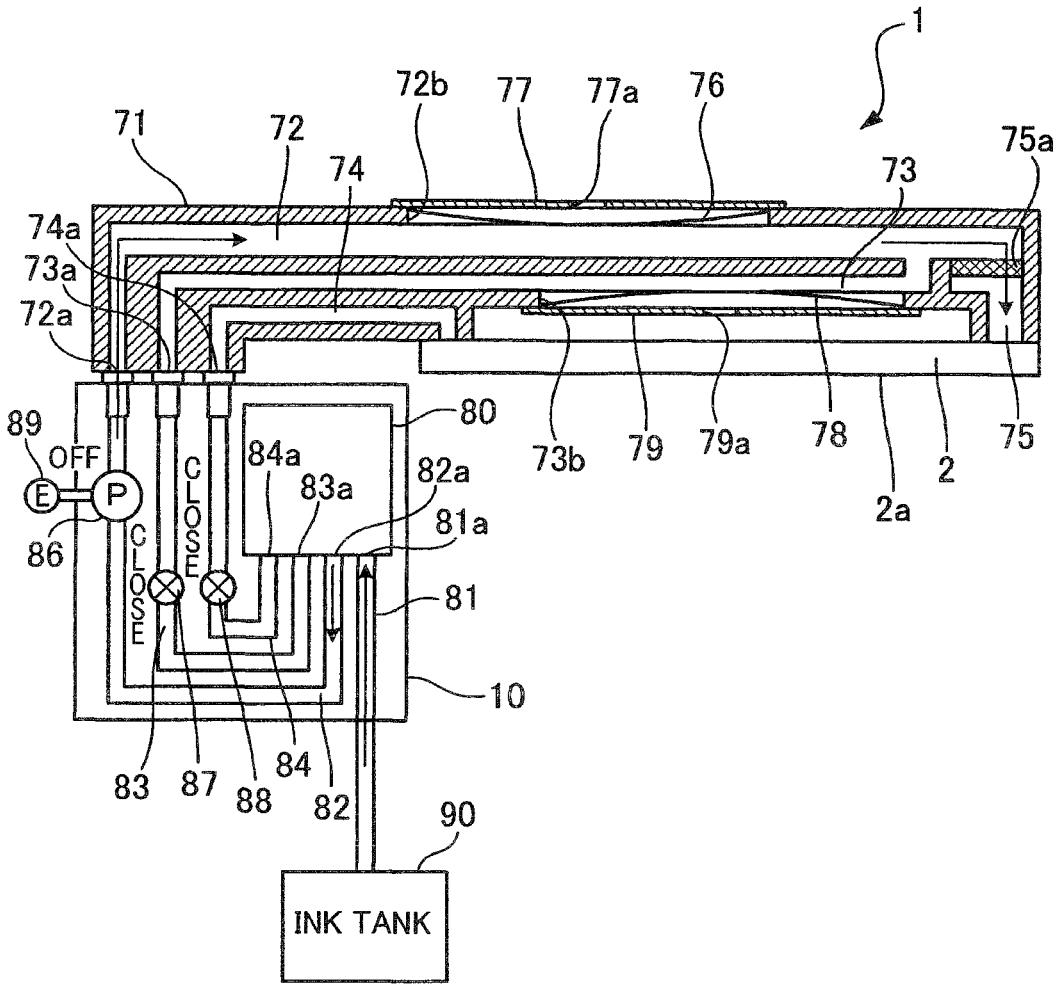
FIG. 2 is a longitudinal section of the inkjet head and the ink supply unit shown in FIG. 1.

Now, the inkjet head 1 will be described with reference to FIG. 2. As shown in FIG. 2, the inkjet head 1 includes a reservoir unit 71 and a head main body 2.

The reservoir unit 71 is a passage forming component which is fixed to the upper surface of the head main body 2 and supplies ink to the head main body 2. Inside the reservoir unit 71 formed are an ink inflow passage 72, an ink outflow passage 75, a first exhaust passage 73, and a second exhaust passage 74.

The ink inflow passage 72 has an inflow opening 72*a* at the lower surface of the reservoir unit 71. Ink supplied from the ink supply unit 10 flows into the ink inflow passage 72 via the inflow opening 72*a*. The ink inflow passage 72 functions as an ink reservoir where the inflow ink is temporarily stored. At the inner wall of the ink inflow passage 72, a hole 72*b* is formed to penetrate the upper outer wall surface of the reservoir unit 71. The hole 72*b* is sealed from the outside of the reservoir unit 71 by a flexible resin film 76. The resin film 78 functions a part of the inner wall surface of the ink inflow passage 72. As the resin film 76 deforms in accordance with a change in the ink pressure in the ink inflow passage 72, the film functions as a damper for restraining changes in the ink pressure. The resin film 76 makes it possible to realize the damper function at low cost. When printing is carried out, the resin film 76 is slightly curved toward the inside of the ink inflow passage 72. On the outer wall surface of the reservoir unit 71, a plate-shaped regulating member 77 is fixed to cover the resin film 76, in order to prevent the resin film 76 from being curved toward the outside of the reservoir unit 71. This arrangement makes it possible to prevent the resin film 76 from being excessively deformed and broken when the ink pressure in the ink inflow passage 72 becomes abnormally high. The regulating member 77 has a atmosphere introducing hole 77*a*, and hence the pressure at the space between the regulating member 77 and the resin film 76 is always kept at the atmospheric pressure. This allows the resin film 76 to easily deform.

The ink outflow passage 75 is connected to the ink inflow passage 72 via a filter 75*a* and is also connected to the head main body 2. When printing is carried out, ink from the ink supply unit 10 passes through the ink inflow passage 72 and the ink outflow passage 75 and is then supplied to the head main body 2.

The first exhaust passage 73 is connected with the ink inflow passage 72 at an upstream of the filter 75*a*, and contacts the ink supply unit 10 via a first outflow opening 73*a* formed on the lower surface of the reservoir unit 71. At the lower inner wall surface of the first exhaust passage 73, a hole 73*b* is formed to penetrate the lower outer wall of the reservoir unit 71. The hole 73*b* is sealed from the outside of the reservoir unit 71 by a flexible resin film 78. The resin film 78 functions as a part of the inner wall surface of the first exhaust passage 73. As the resin film 78 deforms in accordance with a change in the ink pressure in the first exhaust passage 73, the film has a damper function to restrain changes in the ink pressure. This resin film 78 makes it possible to realize the damper function at low cost. When printing is carried out, the resin film 78 is slightly curved toward the inside of the first exhaust passage 73. On the lower outer wall surface of the reservoir unit 71, a plate-shaped regulating member 79 is fixed to cover the resin film 78, in order to prevent the resin film 78 from being curved toward the outside of the reservoir unit 71. This prevents the resin film 78 from excessively deformed and broken when the ink pressure of the first exhaust passage 73 becomes excessively high. The regulating member 79 has an atmosphere introducing hole 79*a*, and hence the pressure at the space between the regulating member 79 and the resin film 78 is always kept at the atmospheric pressure. This allows the resin film 78 to easily deform. During later-described first ink circulation, ink from the ink supply unit 10 passes through the ink inflow passage 72 and the first exhaust passage 73 and then returns to the ink supply unit 10 via the outflow opening 73*a* (see FIG. 5A).

The second exhaust passage 74 is connected to the head main body 2 and is also connected to the ink supply unit 10 via a second outflow opening 74*a* formed at the lower surface of the reservoir unit 71. During the later-described second ink circulation, ink from the ink supply unit 10 passes through the ink inflow passage 72, the ink outflow passage 75, and the head main body 2, and then returns to the ink supply unit 10 after passing through the second exhaust passage 74 (see FIG. 5B).

Figure 3:
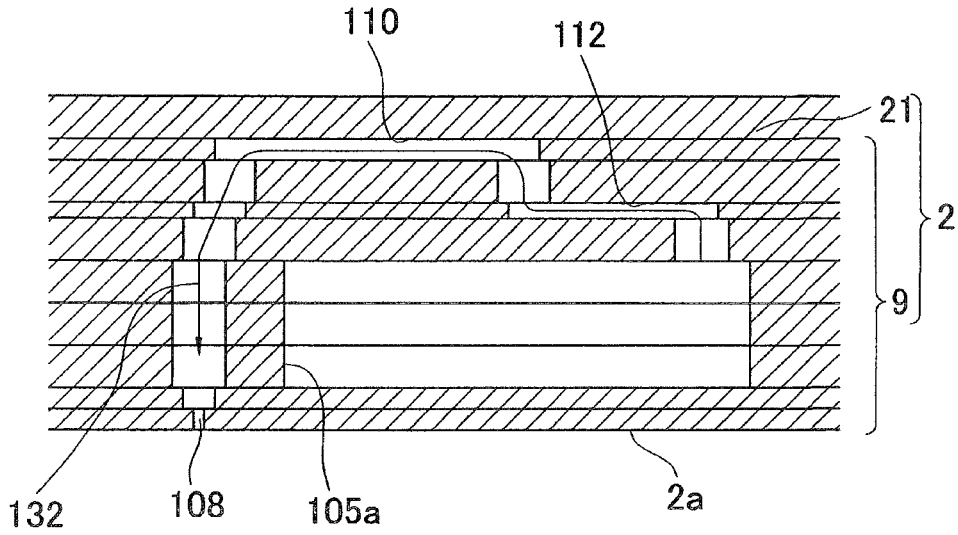
FIG. 3 is a partial cross section of the inkjet head shown in FIG. 2.

As shown in FIG. 3, the head main body 2 includes a passage unit 9 and an actuator unit 21. The passage unit 9 is a laminated body in which a plurality of metal plates made of stainless steel are aligned with each other and laminated, and has a common ink chamber 105*a* connected to the ink outflow passage 75 and the second exhaust passage 74 of the reservoir unit 71 and a plurality of individual ink passages 132 connected to the common ink chamber 105*a*. In the present embodiment, passages which are in the inkjet head 1 but are not the individual ink passages 132 may be termed internal passages. On the lower surface of the passage unit 9 formed is an ejection surface 2*a*, where ejection openings 108 aligned in the main scanning direction are formed. Each individual ink passage 132 extends from the ejection opening of the common ink chamber 105*a* to the ejection opening 108 via the aperture 112 and the pressure chamber 110.

The actuator unit 21 includes a plurality of actuators which correspond to pressure chambers 110, respectively, and are unimorph piezoelectric elements each capable of operating independently. The actuator unit 21 has a function to selectively apply an ejection energy to the ink in the pressure chamber 110. Each actuator is an example of an ejection energy applying element. The actuator unit 21 is constituted by unillustrated three piezoelectric sheets made of a lead zirconate titanate (PZT) ceramic material having ferroelectricity. The topmost piezoelectric sheet is polarized in the thickness directions, and the upper surface of this piezoelectric sheet is provided with a plurality of individual electrodes. Between the polarized topmost piezoelectric sheet and the piezoelectric sheet immediately below the topmost sheet, a common electrode is provided to cover the entirety of the sheets. As such, the individual electrodes corresponding to the respective pressure chambers 110 and the common electrode sandwich the polarized piezoelectric sheet. When the electric potential of an individual electrode is arranged to be different from that of the common electrode so that an electric field is applied to the topmost piezoelectric sheet in the polarization direction, the part of the piezoelectric sheet where the electric field is applied functions as a driving active portion which is warped on account of the piezoelectric effect. As a result, the ink in the pressure chamber 110 receives an ejection energy with which an ink droplet is discharged through an ejection opening 108.

When printing is carried out, the ink supplied from the ink outflow passage 75 of the reservoir unit 71 flows from the ejection opening of the common ink chamber 105*a* into each individual ink passage 132, and then reaches the ejection openings 108 as an ejection energy is applied to the ink by the actuator. During the later-described second ink circulation, the ink supplied from the ink outflow passage 75 of the reservoir unit 71 flows from the common ink chamber 105*a* into the second exhaust passage 74 of the reservoir unit 71 via an unillustrated discharging slot (see FIG. 5B). Alternatively, a bypass passage which connects the ink outflow passage 75 with the second exhaust passage 74 is provided between the reservoir unit 71 and the common ink chamber 105*a* and passages are provided at a plurality of parts of the bypass passage to be connected to the common ink chamber 105*a*, with the result that ink supply to the common ink chamber 105*a* is stabilized and ink is circulated to pass through the bypass passage during the later-described second ink circulation.

The ink supply units 10 are connected to parts around the left edge of the lower surface of the inkjet head 1 in FIG. 1, and supply ink to the inkjet heads 1. These ink supply units 10 will be detailed. As shown in FIG. 2, each ink supply unit 10 includes a sub-tank 80, an ink supply tube 81, an ink feeding tube 82, a first ink return tube 83, and a second ink return tube 84 which are connected to the sub-tank 80, a pump 86 provided on the ink feeding tube 82, an encoder 89 attached to the pump 86, a first valve 87 provided on the first ink return tube 83, and a second valve 88 provided on the second ink return tube 84.

The sub-tank 80 has a storage chamber for storing ink supplied to the inkjet head 1, and is provided with a supply opening 81*a*, an outflow opening 82*a*, and inflow openings 83*a* and 84*a*. The supply opening 81*a* is connected to the ink supply tube 81, the outflow opening 82*a* is connected to the ink feeding tube 82, the inflow opening 83*a* is connected to the first ink return tube 83, and the inflow opening 84*a* is connected to the second ink return tube 84.

The ink feeding tube 82 is connected to the sub-tank 80 at one end via the outflow opening 82*a* and is connected to the ink inflow passage 72 of the reservoir unit 71 at the other end via the inflow opening 72*a*. The ink stored in the sub-tank 80 is supplied to the ink inflow passage 72 of the reservoir unit 71 via the ink feeding tube 82. The pump 86 functions as supplying means for forcibly supplying the ink stored in the sub-tank 80 to the reservoir unit 71 via the ink feeding tube 82. In the present embodiment, the pump 86 is a diaphragm pump (displacement pump). The pump 86 also functions as a check valve which prevents ink from flowing from the ink feeding tube 82 into the sub-tank 80. The encoder 89 is a revolution counter which detects the revolution of the pump 86 as an operating state of the pump 86 and outputs the detection result to the control unit 16 (see FIG. 4).

The first ink return tube 83 is connected to the sub-tank 80 at one end via the inflow opening 83*a* and is connected to the first exhaust passage 73 of the reservoir unit 71 at the other end via the first outflow opening 73*a*. The first valve 87 is an adjusting valve by which the flow rate of ink in the first ink return tube 83 is adjusted.

The second ink return tube 84 is connected to the sub-tank 80 at one end via the inflow opening 84*a* and is connected to the second exhaust passage 74 of the reservoir unit 71 at the other end via the second outflow opening 74*a*. The second valve 88 is an adjusting valve by which the flow rate of ink in the second ink return tube 84 is adjusted.

Figure 4:
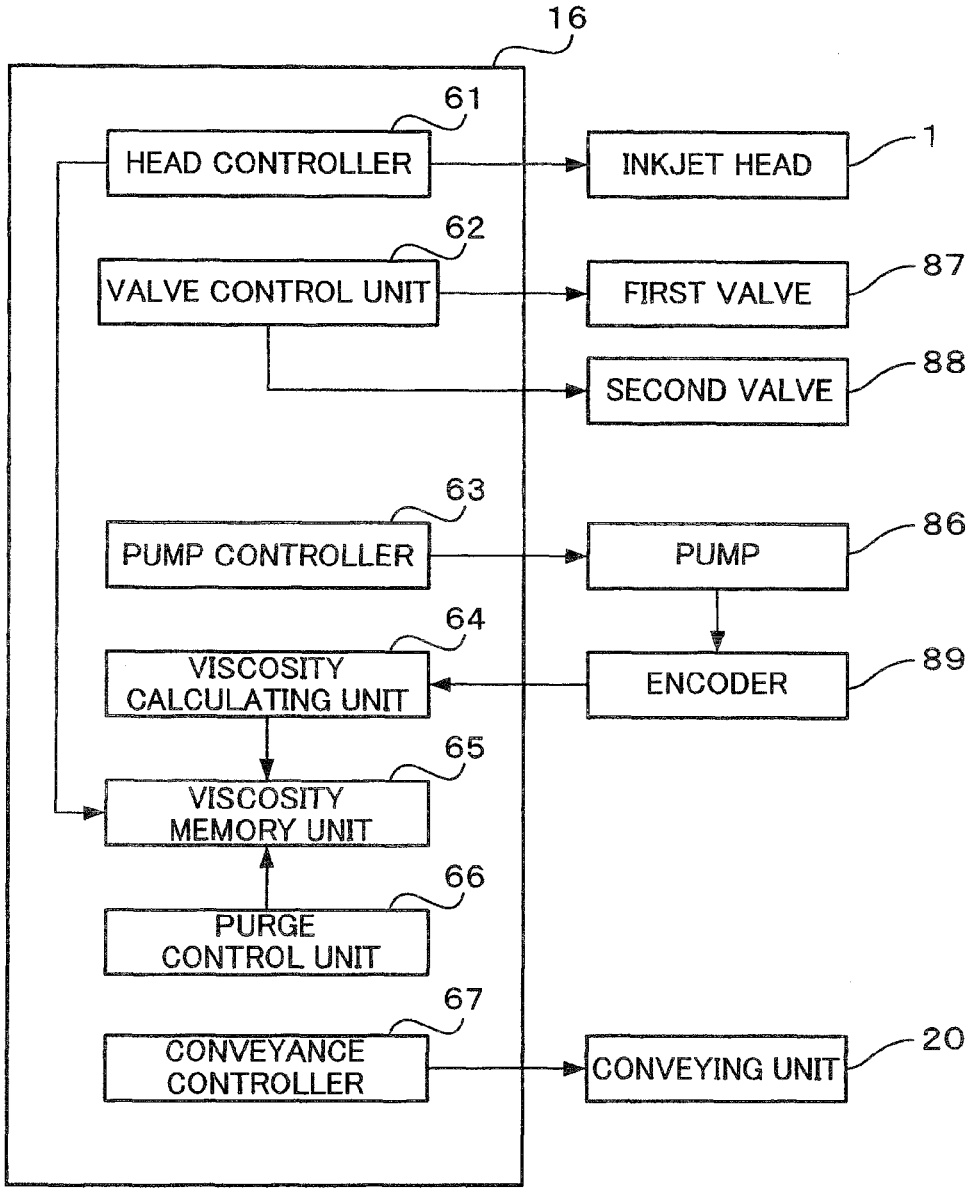
FIG. 4 is a functional block diagram of the control unit shown in FIG. 1.

The control unit 16 controls the entirety of the inkjet printer 101, and includes, as shown in FIG. 4, a head controller 61, a valve control unit 62, a pump controller 63, a conveyance controller 67, a viscosity calculating unit 64, a viscosity memory unit 65, and a purge control unit 66. The head controller 61 as driving means controls discharging of ink droplets from the ejection openings 108 by driving the actuator unit 21 of each inkjet head. In so doing, the head controller 61 drives the actuator unit 21 such that, as the ink viscosity (described later) of the ink in each inkjet head 1 which data is stored in the viscosity memory unit 65 increases, an ejection energy applied to the pressure chamber 110 increases, in other words, a drive voltage supplied to the individual electrode of the actuator unit 21 increases.

The valve control unit 62 controls the first valve 87 and the second valve 88. The pump controller 63 controls the pump 86 by outputting a PWM (Pulse Width Modulation) signal. The conveyance controller 67 controls the conveying unit 20. When printing is carried out, the pump controller 63 stops the pump 86 and the valve control unit 62 closes the first valve 87 and the second valve 88. In this state, the conveyance controller 67 controls the conveying unit 20 so that a sheet P is conveyed at a predetermined speed, whereas the head controller 61 controls each inkjet head 1 so that ink droplets are ejected from the ejection openings 108 at timings with which a desired image is formed on the sheet P, when the sheet P passes through the positions immediately below the respective inkjet heads 1. It is noted that the ink in the sub-tank 80 is allowed to flow into the reservoir unit 71 via the ink feeding tube 82, even if the pump 86 has been stopped.

The viscosity calculating unit 64 performs a viscosity calculation process to calculate the ink viscosity of the ink in each inkjet head 1. In the present embodiment, the viscosity calculation process is a process included in a later-detailed maintenance operation. The maintenance operation is an operation to remove foreign matters and/or bubbles from the inkjet heads 1, and is started when the inkjet printer 101 is activated, when the standby time exceeds a predetermined time, or when an instruction is made by the user.

Figure 5A:
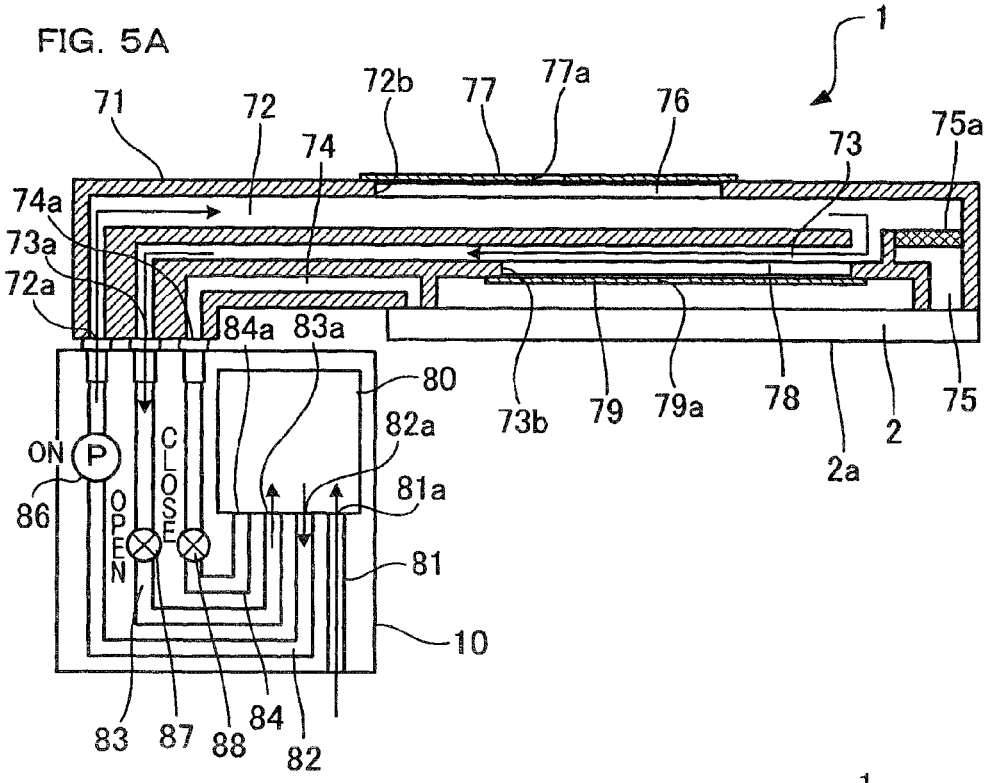
FIG. 5A shows the flow of ink when first ink circulation is carried out for the inkjet head and the supply unit shown in FIG. 2.

When the viscosity calculation process starts, the viscosity calculating unit 64 generates a signal with which the pump 86 drives at a predetermined instructed revolution under the control of the pump controller 63, after the first valve 87 is opened whereas the second valve 88 is closed under the control of the valve control unit 62 (see FIG. 5A). The pump 86 receives a predetermined electric power corresponding to the predetermined instructed revolution. As the pump 86 drives at a revolution corresponding to the ink viscosity, the ink stored in the sub-tank 80 is forcibly supplied to the ink inflow passage 72 via the ink feeding tube 82 at the flow rate corresponding to the ink viscosity. Since the first valve 87 is open at this moment, the passage from the ink inflow passage 72 to the sub-tank 80 via the first exhaust passage 73 and the first ink return tube 83 has a lower resistance than the passages from the ink inflow passage 72 to the ejection openings 108 via the ink outflow passage 75 and the common ink chamber 105*a*. For this reason, the first ink circulation is carried out so that the ink supplied to the ink inflow passage 72 hardly flows into the ink outflow passage 75 and passes through the first exhaust passage 73 and the first ink return tube 83 in this order and returns to the sub-tank 80. However, when an amount of ink supplied by the pump 86 is excessively large, the ink pressure of the ink inflow passage 72 becomes excessively high and hence the ink supplied to the ink inflow passage 72 flows into the ink outflow passage 75, with the result that the ink leaks out from the ejection openings 108. It is therefore necessary to adjust an amount of ink supply in this case, as described later.

As the ink viscosity increases, the output (actual revolution) of the pump 86 decreases with respect to the electric power (voltage required for low-speed revolution) input from the pump controller 63 to the pump 86. The power input to the pump 86 is represented by an average duty regarding the PWM signal. After the ink flow becomes stable after a predetermined time elapses from the start of the first ink circulation, the encoder 89 detects the revolution of the pump 86 during the first ink circulation, and then calculates the ink viscosity based on the revolution detected by the viscosity calculating unit 64 and the power input to the pump 86. For example, the viscosity calculating unit 64 may calculate the ink viscosity by substituting for the revolution of the pump 86 and the power input to the pump 86 into a predetermined relational expression (which takes into account of the flow resistance of the passage system in the case of the first ink circulation and represents a relation among the ink viscosity, the revolution of the pump 86, and the power input to the pump 86). In another example, the viscosity calculating unit 64 may calculate the ink viscosity with reference to a table which is stored in advance and shows a relation among the ink viscosity, the revolution of the pump 86, and the power input to the pump 86. The viscosity memory unit 65 stores the ink viscosity calculated by the viscosity calculating unit 64. The viscosity calculating unit 64 determines that abnormalities have occurred in the pump 86 when the revolution of the pump 86 detected by the encoder 89 goes beyond a predetermined range, and the unit 64 terminates the viscosity calculation process and generates a signal to notify the user of the occurrence of abnormalities. In addition to this, the viscosity calculating unit 64 generates a signal representing information to prompt the user to discard the ink, when the calculated ink viscosity goes beyond a predetermined range. Based on these signals, notifications to the user are displayed on an unillustrated display.

Figure 5B:
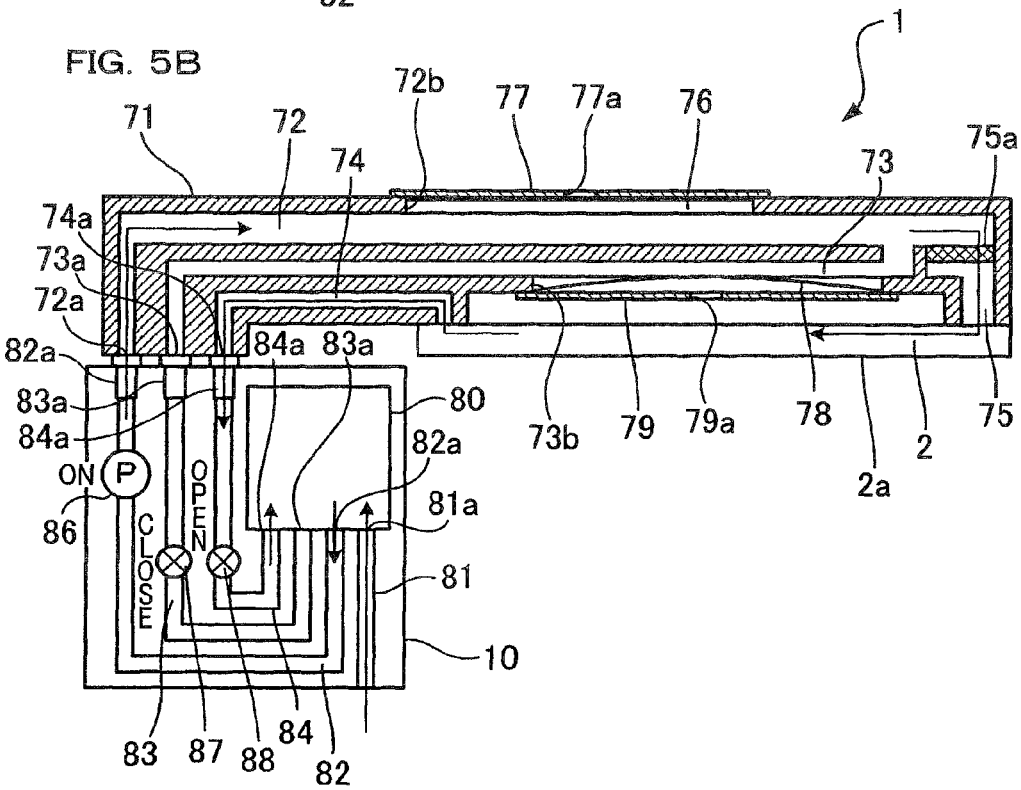
FIG. 5B shows the flow of ink when second ink circulation is carried out for the inkjet head and the supply unit shown in FIG. 2.

The purge control unit 66 generates, subsequent to the viscosity calculation process, a signal which instructs to perform circulation purging for removing bubbles and/or foreign matters in the inkjet head 1, as the pump 86, the first valve 87, and the second valve 88 of each ink supply unit 10 are controlled by the pump controller 63 and the valve control unit 62. Referring to FIG. 5A and FIG. 5B, the circulation purging will be described. This circulation purging is an operation to circulate ink inside the inkjet head 1 so that foreign matters and/or bubbles accumulated in the internal passages of the inkjet head 1 are removed. Ideally, the circulation purging is speedily performed so as to prevent ink from leaking out through the ejection openings. As the circulation purging starts, a first circulation operation and a second circulation operation are serially carried out.

In response to the signal generated by the purge control unit 66, as shown in FIG. 5A, the pump 86 drives under the control of the pump controller 63, after the first valve 87 is opened whereas the second valve 88 is closed under the control of the valve control unit 62. As a result, the first circulation operation starts, and the ink stored in the sub-tank 80 is forcibly supplied to the ink inflow passage 72 via the ink feeding tube 82, by an amount corresponding to the ink viscosity. The ink supplied to the ink inflow passage 72 does not flow into the ink outflow passage 75, and the first ink circulation is carried out again so that the ink passes through the first exhaust passage 73 and the first ink return tube 83 in this order and returns to the sub-tank 80. In this case, the instructed revolution of the pump 86 (which may be represented by an input power or a flow rate of ink supplied by the pump 86 per unit of time) is determined, based on the passage resistance regarding the passages of the first ink circulation and the ink viscosity stored in the viscosity memory unit 65, to be the highest revolution (an input power or a flow rate of ink per unit of time) within a range which is higher than the instructed revolution (power input of flow rate of ink per unit of time) of the pump 86 in the aforesaid viscosity calculation process by the viscosity calculating unit 64 but with which the ink meniscus formed at the ejection openings 108 is not broken, i.e. ink does not leak out through the ejection openings 108. Because the withstanding pressure of the ink meniscus formed at the ejection openings 108 increases in accordance with the ink viscosity, the revolution of the pump 86 in the first ink circulation is arranged to increase as the ink viscosity stored in the viscosity memory unit 65 increases.

As a result of the first ink circulation, the bubbles and/or foreign matters in the ink inflow passage 72, in particular the bubbles and/or foreign matters on the filter 75*a* serially pass through the first exhaust passage 73 and the first ink return tube 83 along with the ink, and are in the end trapped in the sub-tank 80.

During the first ink circulation, the ink pressures in the ink inflow passage 72 and the first exhaust passage 73 are higher than those during printing. For this reason, the resin film 76 of the ink inflow passage 72 closely contacts the regulating member 77 and the resin film 78 of the first exhaust passage 73 closely contacts the regulating member 79. After the first ink circulation is carried out for a predetermined time, the purge control unit 66 stops the pump 86 by the pump controller 63, and then closes the first valve 87 by the valve control unit 62. As a result the first circulation operation is completed. The time to execute the first ink circulation is arranged to increase as the ink viscosity stored in the viscosity memory unit 65 increases.

Thereafter, in response to the signal generated by the valve control unit 62, as shown in FIG. 5B, the pump 86 drives under the control of the pump controller 63 after the first valve 87 is closed and the second valve 88 is opened under the control of the valve control unit 62. As a result, the second circulation operation starts so that the ink stored in the sub-tank 80 is forcibly supplied to the common ink chamber 105*a* of the head main body 2 via the ink feeding tube 82, the ink inflow passage 72, and the ink outflow passage 75, by an amount corresponding to the ink viscosity. Since the second valve 88 is open at this moment, the passage from the common ink chamber 105*a* to the sub-tank 80 via the second exhaust passage 74 and the second ink return tube 84 has a lower resistance than the passages from the common ink chamber 105*a* to the ejection openings 108 via the individual ink passages 132. For this reason, the second ink circulation is carried out so that the ink supplied to the common ink chamber 105*a* does not flow into any individual ink passages 132 and passes through the second exhaust passage 74 and the second ink return tube 84 in this order and returns to the sub-tank 80. In this case, the instructed revolution of the pump 86 regarding the second ink circulation (which revolution may be represented by an input power or a flow rate of ink supplied by the pump 86 per unit of time) is determined, based on the passage resistance regarding the passages of the second ink circulation and the ink viscosity stored in the viscosity memory unit 65, to be the highest revolution (an input power or a flow rate of ink per unit of time) within a range with which the ink meniscus formed at the ejection openings 108 is not broken, i.e. ink does not leak out from the ejection openings 108. Because the withstanding pressure of the ink meniscus formed at the ejection openings 108 increases in accordance with the ink viscosity, the revolution of the pump 86 in the second ink circulation is arranged to increase as the ink viscosity stored in the viscosity memory unit 65 increases.

As a result of the second ink circulation, the bubbles and/or foreign matters in the ink outflow passage 75 and the common ink chamber 105*a* serially pass through the second exhaust passage 74 and the second ink return tube 84 along with the ink and are in the end trapped in the sub-tank 80.

During the second ink circulation, the ink pressure in the ink inflow passage 72 is higher than the pressure during printing. For this reason, the resin film 76 of the ink inflow passage 72 closely contacts the regulating member 77. After the second ink circulation is carried out for a predetermined time, the purge control unit 66 stops the pump 86 by the pump controller 63, and then closes the second valve 88 by the valve control unit 62. This is the completion of the second circulation operation. In the same manner as the first ink circulation, the time to execute the second ink circulation is arranged to increase as the ink viscosity stored in the viscosity memory unit 65 increases. This is the end of the circulation purging.

Figure 6:
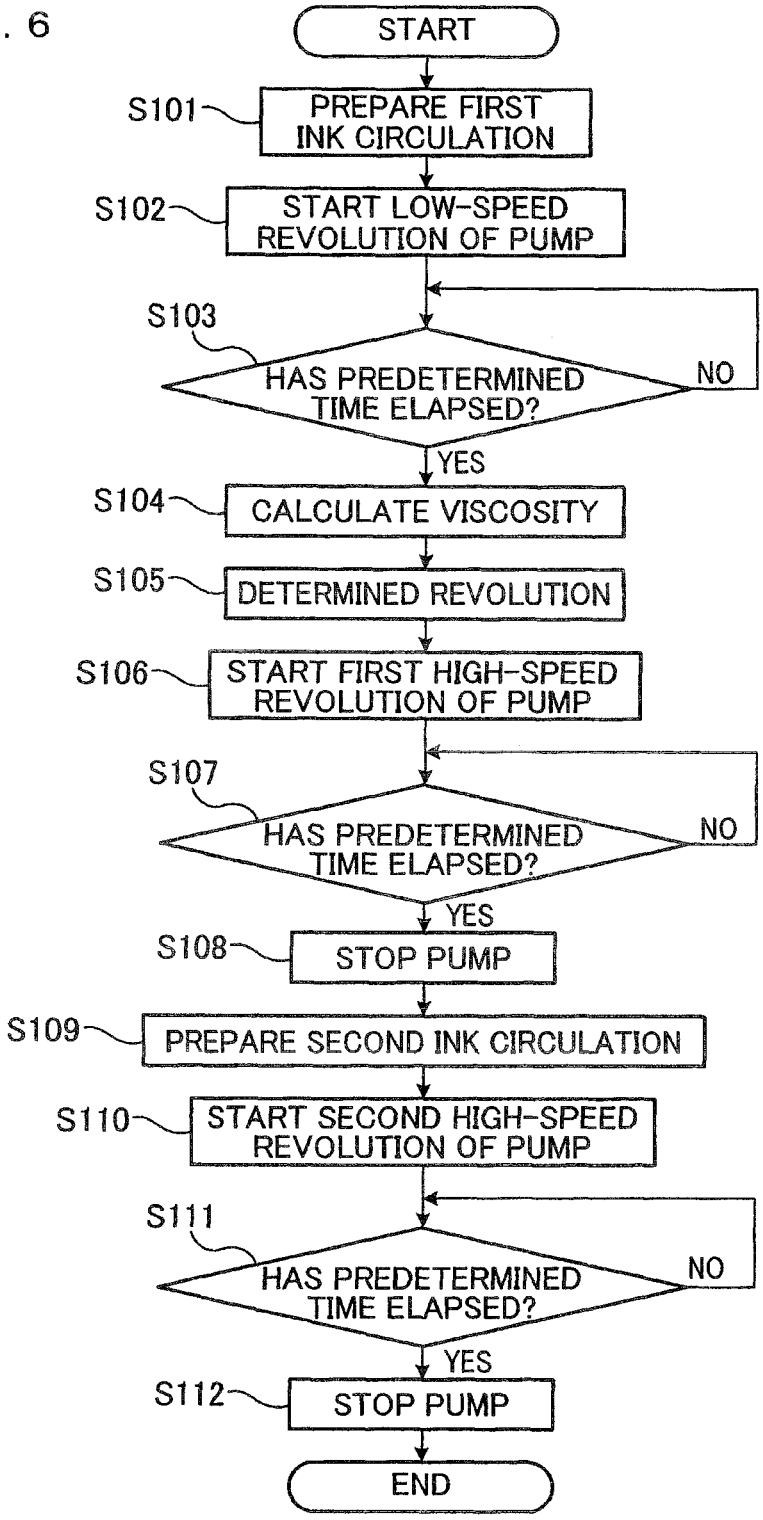
FIG. 6 is a flowchart showing the sequence of the maintenance operation by the control unit shown in FIG. 4.

Now, the maintenance operation will be detailed with reference to FIG. 6. In the maintenance operation, the viscosity calculation process and the circulation purging are successively carried out. As the viscosity calculation process starts, the viscosity calculating unit 64 prepares for the first ink circulation to open the first valve 87 and close the second valve 88 under the control of the valve control unit 62 (S101). Subsequently, the viscosity calculating unit 64 instructs, via the pump controller 63, the pump 86 to drive at a predetermined low revolution (S102). As a result the first ink circulation starts. The viscosity calculating unit 64 continues the first ink circulation until the ink flow regarding the first ink circulation becomes stable, by means of the valve control unit 62 and the pump controller 63. More specifically, the first ink circulation is continued until a predetermined time which is determined in advance and at the end of which the ink flow regarding the first ink circulation is stable elapses from the start of the low-speed revolution of the pump 86 (S103). The low-speed predetermined revolution of the pump 86 is preferably arranged to be a relatively high revolution with which the ink meniscus is not broken, i.e. ink does not leak out through the ejection openings 108 in all conceivable ink viscosity ranges. After the ink flow becomes stable, the encoder 89 detects, as an operating state of the pump 86, an actual revolution of the pump 86 during the first ink circulation. In so doing, the encoder 89 may perform the detection under the control of the viscosity calculating unit 64. Based on the detected revolution and the power input to the pump 86, the viscosity calculating unit 64 calculates the ink viscosity by the above-described relational expression (S104). The calculated ink viscosity is stored in the viscosity memory unit 65.

Subsequent to the viscosity calculation, the purge control unit 66 determines, for the circulation purging, the revolutions (first high-speed revolution and second high-speed revolution) of the pump 86 concerning the first ink circulation and the second ink circulation, respectively, based on the ink viscosity stored in the viscosity memory unit 65, and instructs via the pump controller 63 the pump 86 to drive at the determined first high-speed revolution. As a result the first ink circulation starts (S106). The first high-speed revolution of the pump 86 is preferably arranged, based on the ink viscosity stored in the viscosity memory unit 65 and the passage resistance regarding the passages in the first ink circulation, to be a relatively high revolution which is higher than the predetermined low-speed revolution in the viscosity calculation process but with which the ink meniscus is not broken, i.e. ink does not leak out thorough the ejection openings 108. More preferably, the first high-speed revolution is arranged to be at the upper limit in the aforesaid range. The purge control unit 66 continues the first ink circulation until a predetermined time elapses which is arranged in advance such that the removal of bubbles and/or foreign matters regarding the first ink circulation is suitably carried out within the time (S107). The purge control unit 66 stops the pump 86 after the predetermined time elapses (S 108).

Thereafter, the purge control unit 66 prepares the second ink circulation to open the second valve 88 and close the first valve 87 under the control of the valve control unit 62 (S 109). Under the control of the pump controller 63, the purge control unit 66 instructs the pump 86 to drive at the second high-speed revolution which has been determined As a result the start of the second ink circulation starts (S110). The second high-speed revolution of the pump 86 is preferably arranged, based on the ink viscosity stored in the viscosity memory unit 65 and the passage resistance regarding the passages in the second ink circulation, to be a relatively high revolution with which the ink meniscus is not broken, i.e. ink does not leak out through the ejection openings 108. More preferably, the second high-speed revolution is arranged to be at the upper limit in the aforesaid range. The purge control unit 66 continues the second ink circulation until a predetermined time elapses which is arranged in advance such that the removal of bubbles and/or foreign matters regarding the second ink circulation is suitably carried out within the time (S111). After the predetermined time elapses, the purge control unit 66 stops the pump 86 (S112). As such, the maintenance operation is completed.

As described above, the inkjet printer 101 of the present embodiment is advantageous in that the ink viscosity is accurately calculated without requiring an additional viscosity meter or the like because the viscosity calculating unit 64 calculates in the viscosity calculation process the ink viscosity from a revolution, as an operating state, of the pump 86 during the first ink circulation. This makes it possible to downsize the inkjet printer 101.

Furthermore, the pump 86 is a displacement pump, the encoder 89 detects the revolution of the pump 86 during the first ink circulation, and the viscosity calculating unit 64 calculates the ink viscosity from the detected revolution and the power input to the pump 86. This makes it possible to easily and accurately measure the ink viscosity.

In addition to the above, the instructed revolution of the pump 86 in the first ink circulation regarding the circulation purging (i.e. input power or flow rate of ink per unit of time) is arranged to be higher than the instructed revolution of the pump 86 in the viscosity calculation process (i.e. input power or flow rate of ink per unit of time) and within the range in which the meniscus of ink formed at the ejection openings 108 is not broken. It is therefore possible to efficiently remove foreign matters and/or bubbles in the inkjet head 1 without wasting ink. Moreover, since the circulation purging is carried out subsequent to the viscosity calculation process, the circulation purging is carried out based on the calculated ink viscosity before the viscosity greatly changes. The circulation purging is therefore efficiently carried out.

In addition to the above, since the circulation purging is carried out in each of the first ink circulation and the second ink circulation, it is possible to carry out the circulation purging at a revolution of the pump 86 suitable for each of the first ink circulation and the second ink circulation. This makes it possible to efficiently remove bubbles and/or foreign matters in the inkjet head 1.

In addition to the above, when printing is carried out, the head controller 61 controls a drive voltage input to each individual electrode of the actuator unit 21 such that an ejection energy applied to the ink in the pressure chamber 110 increases as the ink viscosity in each inkjet head 1, which is stored in the viscosity memory unit 65, is increased. As such, the ejection energy is adjusted in accordance with the ink viscosity, and hence the ink discharging characteristics are stable and printing of high-quality images is possible.

In addition to the above, after the ink flow becomes stable after a predetermined time elapses from the start of the first ink circulation, the viscosity calculating unit 64 calculates the ink viscosity based on the detected revolution of the pump 86 and the power input to the pump 86. the ink viscosity may not be accurately calculated immediately after the start of the first ink circulation because the ink flow is unstable on account of foreign matters and/or turbulence. In this regard, such a calculation error of the ink viscosity is restrained because the ink viscosity is calculated in the state of stable ink flow.

<Variations>

Figure 7:
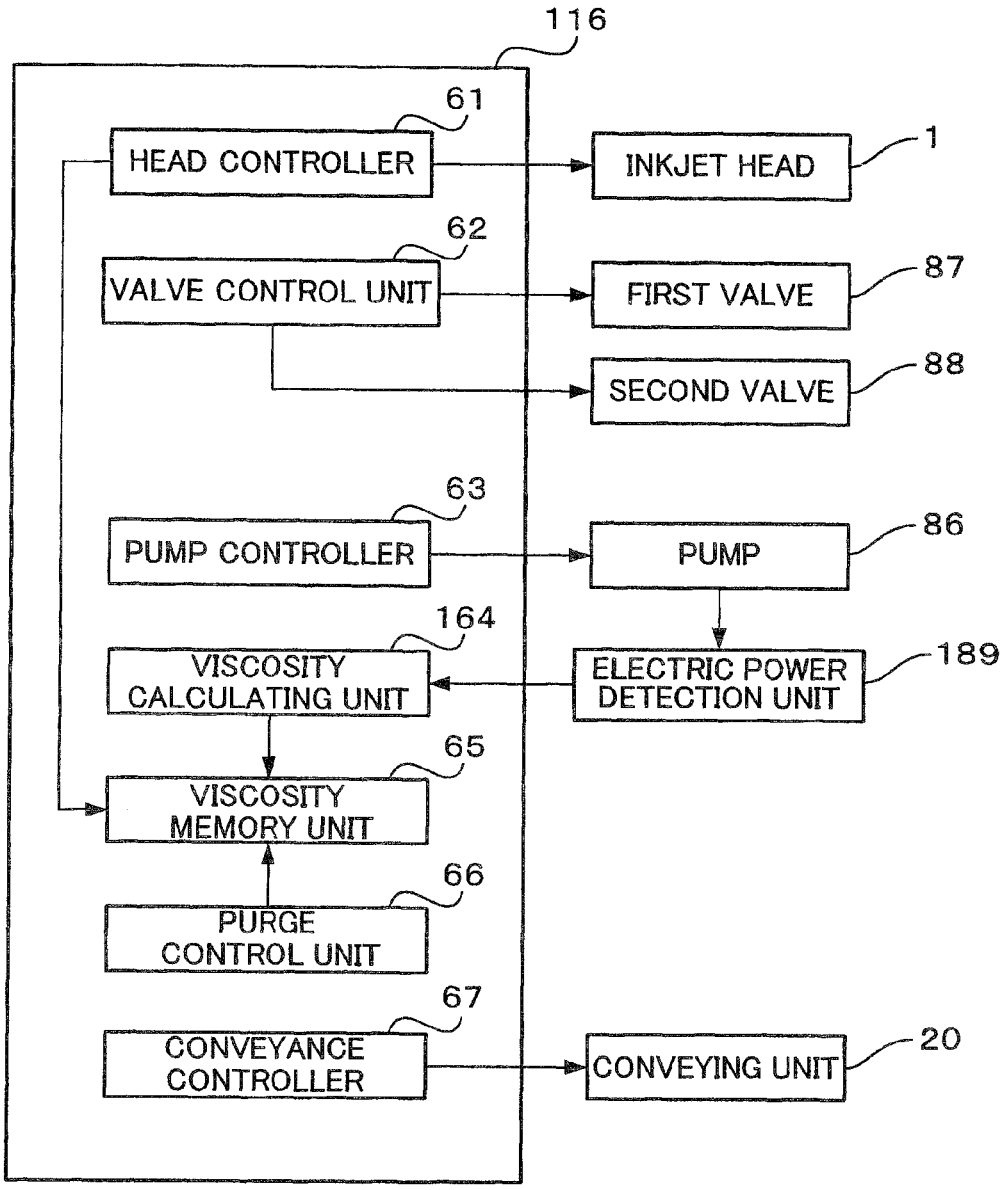
FIG. 7 is a functional block diagram of a control unit according to a variation.

In the embodiment above, the encoder 89 detects the revolution of the pump 86 during the first ink circulation as an operating state of the pump 86 and the viscosity calculating unit 64 calculates the ink viscosity from the detected revolution and the power input to the pump 86. Alternatively, an operating state of the pump 86 is detected by another type of means and the ink viscosity is calculated based on the detection result. For example, as shown in FIG. 7, an electric power detection unit 189 which detects a power supplied to the pump 86 when ink is supplied at a predetermined flow rate per unit of time, i.e. detects a power consumed by the pump 86 is provided in place of the encoder 89, a viscosity calculating unit 164 calculates the torque of the pump 86 from the power detected by the electric power detection unit 189, and the ink viscosity is calculated based on the torque. In this case, the viscosity calculating unit 164 may calculate the ink viscosity from an electric power detected by the electric power detection unit 189 in a state in which the revolution of the pump 86 is stable, or may calculate the ink viscosity from the rising curve of the electric power detected by the electric power detection unit 189 at the start of the rotation of the pump 86. The pump 86 may be a non-displacement pump, e.g. an impeller pump. The displacement pump may be a tube pump.

According to the above, since the electric power detection unit 189 which does not perform mechanical operations is used, it is possible to downsize the apparatus.

According to the embodiment above, the electric power input to the pump 86 in the second ink circulation of the circulation purging is arranged to be the highest revolution within a range in which the ink meniscus at the ejection openings 108 is not broken, i.e. within a range in which ink does not leak out through the ejection openings 108. Alternatively, the instructed revolution of the pump 86 in the second ink circulation of the circulation purging may be arranged at any revolutions as long as ink does not leak out through the ejection openings 108. The power input to the pump 86 in the second ink circulation of the circulation purging may be constant or variable, regardless of the ink viscosity.

In another variation, in the circulation purging, the first valve 87 and the second valve 88 are both opened and the first ink circulation and the second ink circulation are simultaneously done. Also, the internal passages of the inkjet head may be arranged to form only one circulation passage. In this case, the circulation purging is carried out in this one circulation passage. Alternatively, the internal passages of the inkjet head may be arranged to form three or more circulation passages. In this case, the circulation purging may be carried out by selectively switching these circulation passages.

In addition to the above, the head controller 61 may change, in accordance with the ink viscosity stored in the viscosity memory unit 65, the output timing and/or waveform of the drive signal with which the actuator unit 21 is driven. The head controller may not change how to control the actuator unit 21, even if the ink viscosity is changed.

In the embodiment above, the viscosity calculating unit 64 generates a signal indicating information to prompt the user to discard the ink when a calculated ink viscosity is out of a predetermined range. In this regard, fresh ink may be supplied to the sub-tank 80 when a calculated ink viscosity is out of a predetermined range. In an alternative arrangement, when the printer of the embodiment above has an apparatus to control a temperature of ink in the sub-tank 80, the temperature of the ink in the sub-tank 80 is increased when a calculated ink viscosity is higher than an allowable range whereas the temperature of the ink in the sub-tank 80 is decreased when a calculated ink viscosity is lower than the allowable range. Alternatively, a diluent may be injected into the ink in the sub-tank 80 when a calculated ink viscosity is higher than the allowable range.

In addition to the above, the embodiment is arranged so that the revolution of the pump 86 is detected after the ink flow becomes stable after a predetermine time elapses from the start of the first ink circulation, and the viscosity calculating unit 64 calculates the ink viscosity from the difference between the detected revolution and the instructed revolution of the pump 86. In this regard, the timing to calculate the ink viscosity may be different from the above and may be carried out at an arbitrary timing. For example, the ink viscosity may be calculated immediately after the start of the first ink circulation.

In addition to the above, according to the embodiment, the operation to open the first valve 87 or the second valve 88 to switch between the first ink circulation and the second ink circulation indicates that the valve is fully opened. Alternatively, the ink flow rate may be adjusted by opening each of the first valve 87 and the second valve 88 by half or by an arbitrary degree.

In the embodiment above, the ejection energy applying element is an unimorph piezoelectric actuator. Alternatively, the ejection energy applying element may be a bimorph piezoelectric actuator or a heating element which generates bubbles in ink by heating the ink.

The present invention may be used for other liquid ejection apparatuses which eject droplets other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a tank which stores a recording liquid;

a recording liquid ejection head which includes an internal passage having an inflow opening and an outflow opening and a plurality of individual recording liquid passages respectively connecting outlets of the internal passage with ejection openings from which the recording liquid is ejected;

a supply passage which connects the inflow opening with the tank;

a return passage which connects the outflow opening with the tank;

a valve which adjusts a flow rate of the recording liquid on the return passage;

a pump which operates to supply the recording liquid from the tank to the internal passage via the supply passage;

a pump control unit which controls the pump;

a valve control unit which controls the valve;

a detecting unit which detects an operating state of the pump; and a calculating unit which calculates the viscosity of the recording liquid, wherein:

while the valve control unit controls the valve and the pump control unit controls the pump so that the recording liquid in the tank circulates by serially passing through the supply passage, the internal passage, and the return passage, the calculating unit calculates the viscosity of the recording liquid based on the operating state of the pump detected by the detecting unit, and after the calculating unit calculates the viscosity of the recording liquid, the pump control unit controls, based on the calculated viscosity of the recording liquid, the pump so that circulation purging is carried out to circulate the recording liquid to serially pass through the supply passage, the internal passage, and the return passage, in such a way as to achieve a condition that a flow rate per unit of time of the recording liquid supplied by the pump is higher than a circulation flow rate per unit of time of the recording liquid when the calculating unit calculates the viscosity of the recording liquid but is within a range with which no recording liquid leaks through the ejection openings.

2. The liquid ejection apparatus according to claim 1, wherein, the pump is a displacement pump, and the detecting unit is a revolution counter which detects, a revolution of the pump as the operating state of the pump when the pump control unit supplies a predetermined electric power to the pump.

3. The liquid ejection apparatus according to claim 1, wherein, the detecting unit detects, as the operating state of the pump, a power supplied to the pump while the pump control unit controls the pump so that the recording liquid is supplied at a predetermined flow rate per unit of time.

4. The liquid ejection apparatus according to claim 1, wherein, the internal passage has a plurality of the outflow openings, and a plurality of the return passages and a plurality of the valves are provided, the return passages are connected to the different outflow openings, respectively, the valve control unit selects a return passage from the plurality of return passages and controls the valves so that the recording liquid flows into the selected return passage, and the pump control unit controls, in the circulation purging, the pump based on a passage resistance of the return passage selected by the valve control unit and the viscosity of the recording liquid.

5. The liquid ejection apparatus according to claim 1, wherein, the recording liquid ejection head includes:

ejection energy applying elements which apply ejection energy to the recording liquid in the individual recording liquid passages to cause the recording liquid to be discharged through the ejection openings; and a driving unit which drives the ejection energy applying elements, and wherein, the driving unit drives the ejection energy applying elements based on the viscosity of the recording liquid calculated by the calculating unit.

6. The liquid ejection apparatus according to claim 5, wherein, the driving unit drives the ejection energy applying elements such that the ejection energy applied to the recording liquid increase as the viscosity of the recording liquid calculated by the calculating unit increases.

7. The liquid ejection apparatus according to claim 1, wherein, the calculating unit calculates the viscosity of the recording liquid after a predetermined time elapses after circulation of the recording liquid starts.

8. The liquid ejection apparatus according to claim 1, wherein, the recording liquid ejection head is a line-type head on which the ejection openings are aligned in one direction.

* * * * *